US006062421A

United States Patent [19]

Marley

[11] Patent Number: 6,062,421

[45] Date of Patent: May 16, 2000

[54] GLOVE DISPENSING DEVICE

[76] Inventor: Jo Ellen Marley, 217 Madison St., Bristol, Pa. 19007

[21] Appl. No.: 09/012,627

[22] Filed: Jan. 23, 1998

[51] Int. Cl.[7] ..... A47K 10/24

[52] U.S. Cl. ..... 221/45; 221/59

[58] Field of Search ..... 221/45, 46, 59, 221/56, 60, 303, 155; 206/278, 438

[56] References Cited

U.S. PATENT DOCUMENTS

| | | | |
|---|---|---|---|
| D. 332,023 | 12/1992 | Campbell | D6/522 |
| 3,343,716 | 9/1967 | Peebles | 221/59 |
| 4,773,532 | 9/1988 | Stephenson | 206/278 |
| 4,909,413 | 3/1990 | McCutcheon | 221/1 |
| 4,997,105 | 3/1991 | Fischer | 221/45 |
| 5,088,620 | 2/1992 | Kelliher | 221/59 |
| 5,335,811 | 8/1994 | Morand | 221/45 |

*Primary Examiner*—Kenneth W. Noland
*Attorney, Agent, or Firm*—Goldstein & Canino

[57] ABSTRACT

A glove dispensing device comprising a cabinet which is designed to be permanently affixed to a wall for dispensing gloves from the glove boxes stored within the cabinet. The cabinet of the glove dispensing device includes a housing and a cover swingably mounted to the housing to allow glove boxes to be inserted into the housing. The cover is provided with a sliding window which opens to permit removal of one glove at a time while closing the sliding window protects the remaining gloves from contaminants and pollutants from the surrounding environment.

8 Claims, 2 Drawing Sheets

GLOVE DISPENSING DEVICE

BACKGROUND OF THE INVENTION

This invention relates to a glove dispensing device. More particularly, the invention relates to a device which employs a cabinet having a sliding window, designed for allowing a user to retrieve gloves from the glove boxes stored within the cabinet while protecting the remaining gloves from contaminants and pollutants.

Gloves have become essential in the delivery of a wide variety of services, including health care, dental care, restaurant, laboratory, and many others. Despite the importance, there remains no standard manner in which gloves are dispensed. Consequently, gloves are often stored in unpredictable locations varying between different facilities. Moreover, gloves are often misplaced in drawers or cabinets where they are hidden from view, frustrating those who have immediate need for the gloves. Furthermore, gloves are often exposed to the surrounding environment prior to actual use.

While various references uncovered in the prior art provide devices that dispense gloves, no device dispenses gloves directly from commercially available glove boxes, which would eliminate the need to handle or expose the gloves to the surrounding environment prior to actual use, and which is specifically designed for mounting to the wall so that the device and supply of gloves can be easily located.

U.S. Pat. No. 4,997,105 to Fischer discloses a rectangular box-like enclosure fabricated from paper materials for storing a plurality of gloves and for individually dispensing them. The rectangular box, when filled with gloves, is similar to the preexisting commercially available gloves that are packaged in a box. Because Fisher requires the user to manually refill the dispenser with gloves, the gloves may be contaminated while they are exposed to surrounding environment during the refilling process.

U.S. Pat. No. 5,008,620 to Kelliher discloses a glove dispenser which dispenses gloves from a tubular body. This glove dispenser provides some utility for transporting gloves in the tubular body which could be used in emergency situations encountered by the ambulance workers but is not useful for stationary use because the dispenser could be easily hidden or lost in drawers or cabinets.

While these units mentioned above may be suitable for the particular purpose employed, or for general use, they would not be as suitable for the purposes of the present invention as disclosed hereafter.

SUMMARY OF THE INVENTION

It is an object of the invention to provide a glove dispensing device which is simple to use and inexpensive in construction, and permits removal of one glove at a time while protecting the remaining gloves from contaminants and pollutants.

It is another object of the invention to provide a glove dispensing device which utilizes commercially available glove boxes, and yet increases the sanitary status of the gloves because the boxes need only be opened partially and the a user makes contact only with the particular glove being retrieved.

It is yet another object of the invention to provide a glove dispensing device which is designed to be mounted to a wall, visually displaying the glove dispenser rather than being hidden in drawers or cabinets, thereby increasing glove availability for personnel and increasing the likelihood of personnel using the gloves.

It is a further object of the invention to provide a glove dispensing device which will standardize the manner of dispensing gloves across human service environments, increasing the public awareness of glove location regardless of agency or facility and eliminating the frustrations arising from trying to locate gloves in ambiguous and varied storage locations.

The invention is a glove dispensing device comprising a cabinet which is designed to be permanently affixed to a wall for dispensing gloves from the glove boxes stored within the cabinet. The cabinet of the glove dispensing device includes a housing and a cover swingably mounted to the housing to allow glove boxes to be inserted into the housing. The cover is provided with a sliding window which opens to permit removal of one glove at a time while closing the sliding window protects the remaining gloves from contaminants and pollutants from the surrounding environment.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
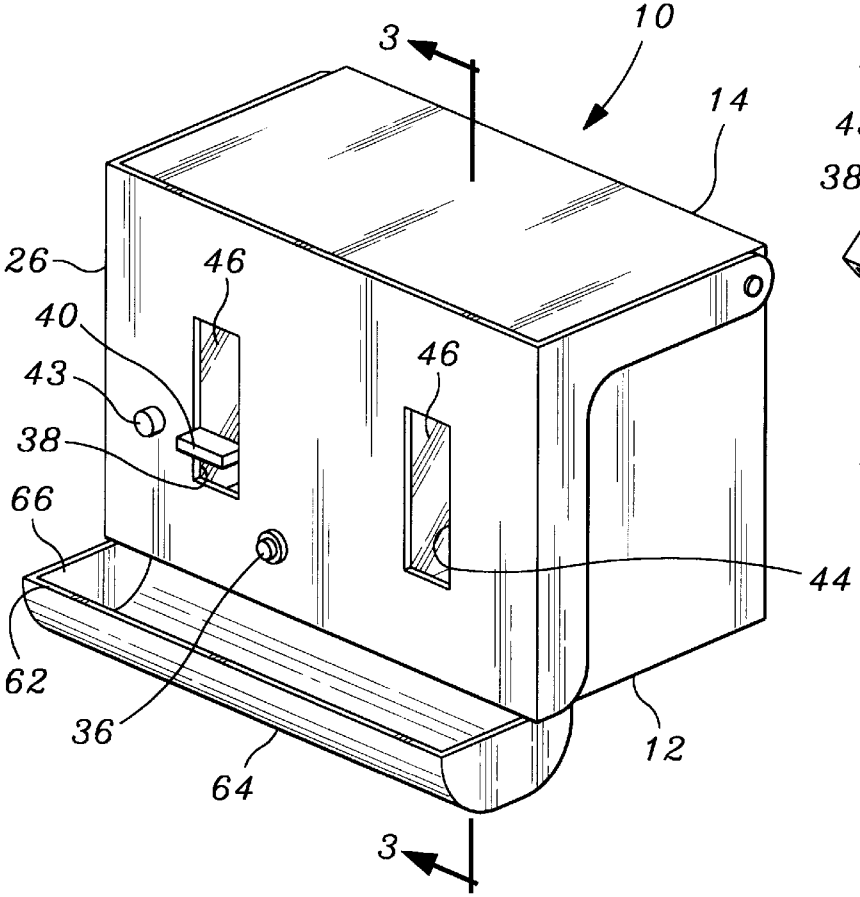
FIG. 1 is a diagrammatic perspective view of the instant invention.

FIG. 1 illustrates a glove dispensing device 10 having a cabinet 12 which is designed for mounting to the wall for holding glove boxes and for dispensing gloves directly from the glove box.

Figure 2:
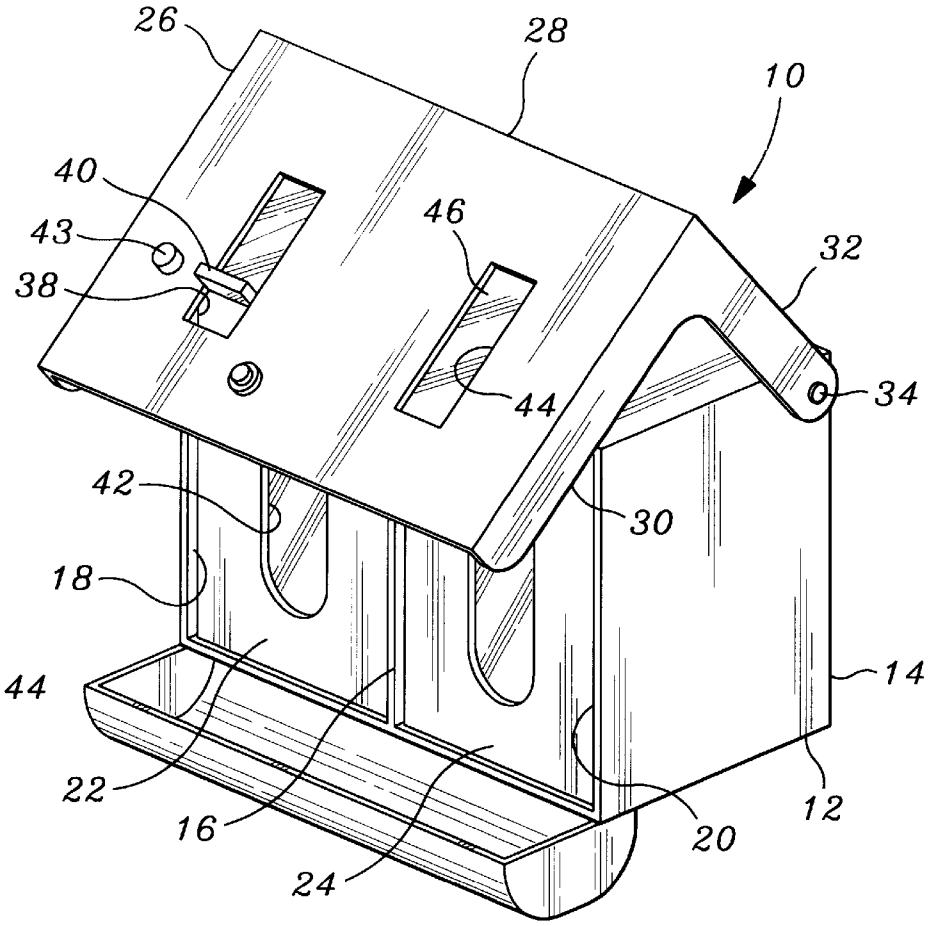
FIG. 2 is a diagrammatic perspective view of the instant invention with the cover swung open from the housing.

The cabinet 12 includes a housing 14 defined by a back panel, a top panel, a bottom panel and side panels. FIG. 2 illustrates a partition 16 provided within the housing 14 to divide the housing 16 into two compartments: a first compartment 18 holds a glove box for immediate use 22, and a second compartment 20 stores a glove box for backup use 24.

The front of the housing 14 is open to permit reception of glove boxes. The cabinet 12 further includes a cover 26 swingably mounted to the housing 14 for closing the open front of the housing 14. The cover 26 is defined by a front panel 28, narrow side panels 30 and a pair of mounting arms 32 extending rearwardly from the upper portion of the narrow side panels 30. The mounting arms 32 are mounted by swing hinges 34 to the upper rear portion of the side panels of the housing 14.

The cover 26 is capable of swinging radially upwardly about the swing hinges 34 to open the cabinet 12 allowing the glove boxes 22 and 24 to be inserted into the housing 14, as depicted in FIG. 2. The cover 26 is normally closed against the housing 14, as depicted in FIG. 1, by a latching means to hold the cover 26 closed, or by any other means as would be appreciated by those skilled in the art. The cover 26 may include a push button 36 for manually disengaging the latch, or alternatively, may include a key operated lock fixture for manually locking the cover 26 to the housing 14.

The cover 26 has a dispensing aperture 38 and a sliding window 40 slidably mounted thereto. The dimensions of the dispensing aperture 38 preferably corresponds with the dimensions of the glove box opening 42 depicted in FIG. 2. The dispensing aperture 38 is situated on the cover 26 so as to permit access to the opening 42 of the glove box 22 placed in the first compartment 18, thereby allowing passage of individual glove from the box 22 through the dispensing aperture 38.

The sliding window 40 is made from a transparent material such as plastic or PLEXIGLAS. The sliding window 40 allows removal of one glove at a time while protecting the remaining gloves from contaminants and pollutants. A button 43 is provided next to the sliding window 40 which allows the user to lock the sliding window 40 in place. The locking feature of the sliding window 40 permits access to glove removal by remaining constantly open or by remaining closed and opening only to retrieve an individual glove.

The cover 26 also has a viewing aperture 44 and a viewing window 46 affixed thereto made from a transparent material such as plastic or PLEXIGLAS. The viewing window 46 enables the user to determine the availability of the backup refill glove box 24 without the necessity of opening the cover 26.

Figure 3:
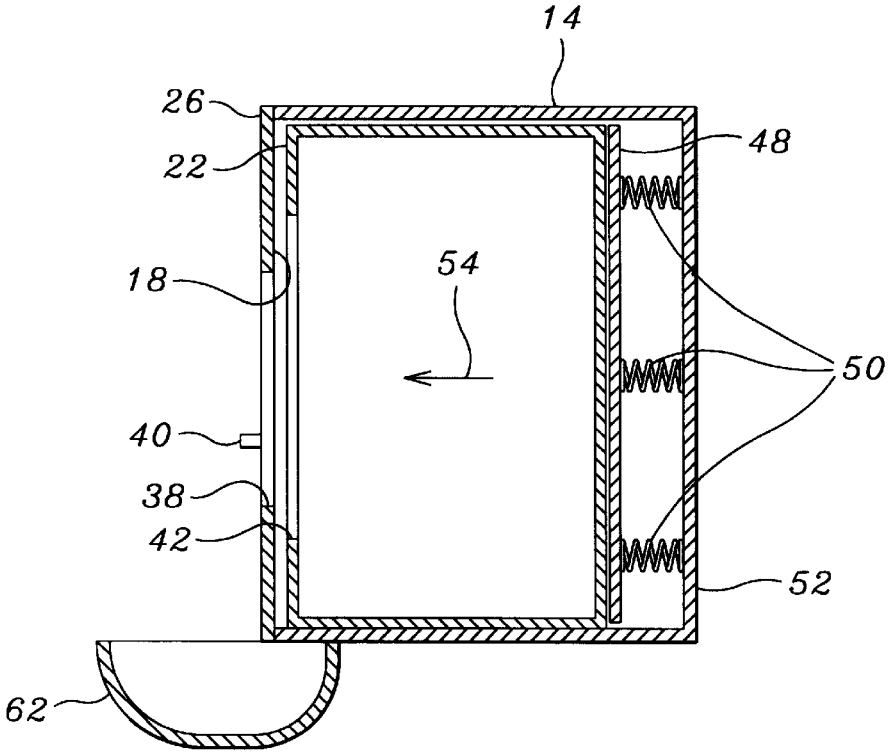
FIG. 3 is a side cross-sectional view, taken on line 3—3 of FIG. 1 of the instant invention.

FIG. 3 illustrates the glove dispensing device 10 including a rectangular plate 48 disposed within the first compartment 18 and a plurality of springs 50 attached between the back panel 52 of the housing 14 and the rectangular plate 48 for pushing the plate 48 toward the cover 26. To illustrate, when the glove box 22 is placed within the first compartment 18 with the cover 26 closed, the springs 50 retained by the back panel 52 of the housing 14 pushes outwardly against the rectangular plate 48, in direction 54, pressing the box 22 against the cover 26, thereby automatically adjusting the depth of the first compartment 18 in order to facilitate glove boxes of different depths. Other means may be employed to push the glove box 22 toward the cover 26 so that the opening 42 in the box 22 is placed immediately adjacent to the dispensing aperture 38 of the cover 26 when the cover 26 is closed against the housing 14.

Figure 4:
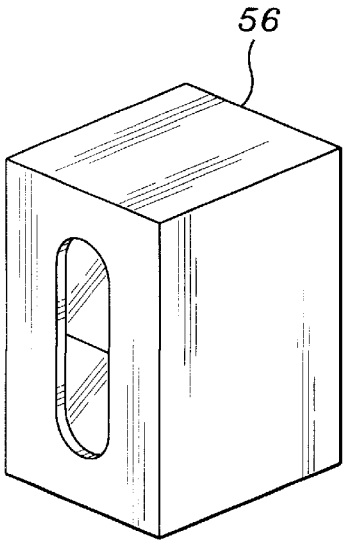
FIG. 4 is a diagrammatic perspective view of a medium glove box.
Figure 5:
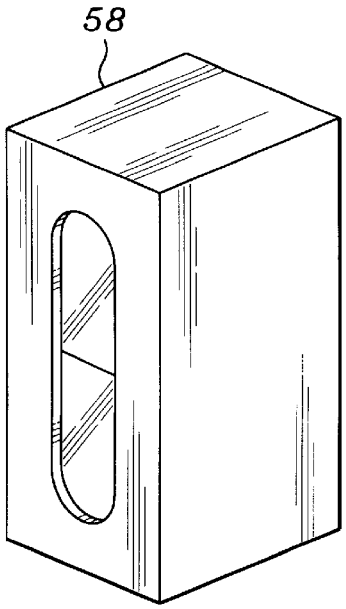
FIG. 5 is a diagrammatic perspective view of a large glove box.
Figure 6:
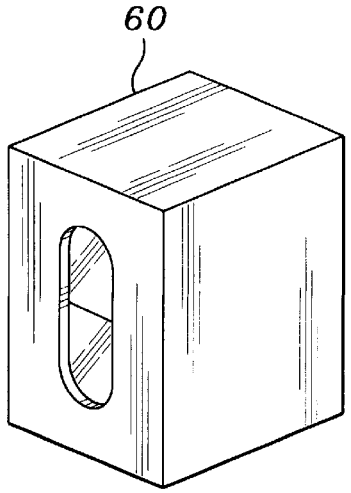
FIG. 6 is a diagrammatic perspective view of a small glove box.

The glove dispensing device 10 is adapted to accommodate the size variety of commercially available glove boxes 56, 58, and 60, which are depicted in FIGS. 4, 5, and 6. In a preferred embodiment, the cabinet 12 is capable of accommodating two large glove boxes 58 that are commercially available, and the same embodiment will work just as well with the smaller glove boxes 56 and 60. However, as will be apparent to those skilled in the art, the dimensions and shape of the cabinet 12 may be modified to suit different number of boxes and different box configurations.

FIG. 1 illustrates the glove dispensing device 10 including a catch tray 62 mounted to the bottom panel of the housing 14 for collecting any fallen gloves and permitting the fallen gloves to remain in the catch tray until they are needed. The catch tray 62 comprises a bottom panel 64 and side panels 66 and is mounted to the front portion of the housing bottom panel. The bottom panel 64 of the catch tray 62 preferably is curved concavely upwardly for temporary holding fallen gloves.

The glove dispensing device 10 is designed to be permanently affixed to the wall, preferably on a highly visible and predictable location. It may be desirable to utilize a sturdy wall mounting fixture since the glove dispensing device 10 will be subjected to a large number of glove retrievals. In addition, it is highly recommended that the glove dispenser devices 10 are installed in a similar location regardless of agency or facility, in an effort to standardize the manner of glove dispensing across human service environments, thereby reducing frustration and time wasted by the personnel constantly searching for gloves.

As vital and necessary as gloves have become in many service industries, it is a goal of this invention to standardize the manner of dispensing gloves in order to increase its availability and increase the likelihood of personnel using gloves during their service delivery. The instant invention not only increases glove availability but also increases the sanitary status of the gloves because the boxes need only be partially opened and the user makes contact only with the particular glove being retrieved while remaining gloves are protected from outside contaminants and pollutants.

Many specific details contained in the above description merely illustrate some preferred embodiments and should not be construed as a limitation on the scope of the invention. Many other variations are possible.

What is claimed is:

1. A glove dispensing device for dispensing gloves from a glove box having an opening, said glove dispensing device comprising:

a) a housing for holding at least one glove box, said housing having an open portion for reception of glove boxes;

b) a cover comprising a dispensing aperture for permitting access to the opening of the glove box within the open portion of the housing, said cover movably mounted to said housing for opening and closing the open portion of said housing;

c) a sliding window slidably mounted to the dispensing aperture of the cover, thereby being capable of opening to permit removal of a glove and being capable of closing to protect the remaining gloves from surrounding environment; and d) a mounting means for mounting the housing on a wall.

2. A glove dispensing device for dispensing gloves from a glove box having an opening, said glove dispensing device comprising:

a) a housing having a back panel, a top panel, a bottom panel and side panels for holding at least one glove box, said housing also having an open front for reception of glove boxes;

b) a cover rotatably mounted to said housing for opening and closing the open front of said housing, said cover having a dispensing aperture for permitting access to the opening of the glove box within the housing;

c) a sliding window slidably mounted to said viewing aperture of the cover, thereby being capable of opening to permit removal of a glove and being capable of closing to protect the remaining gloves from surrounding environment; and d) a mounting means for mounting the housing on a wall.

3. The glove dispensing device of claim 2, further comprising a locking means for locking the sliding window in place, thereby permitting access to glove removal by the sliding window remaining constantly open or by remaining closed and opening only to retrieve an individual glove.

4. The glove dispensing device of claim 3, further comprising a plate disposed within the housing, and a plurality of springs attached between the back panel of the housing and the box pushing plate for pushing the plate toward the cover.

5. The glove dispensing device of claim 4, wherein the cover further comprises a pair of rearwardly extending mounting arms, said mounting arms rotatably mounted to the side panels of the housing.

6. The glove dispensing device of claim 5, wherein the housing further comprises a partition mounted within the housing defining a first compartment for holding a glove box for immediate use, and a second compartment for storing at least one glove box for backup use.

7. The glove dispensing device of claim 6, wherein the cover further comprises a viewing aperture and a viewing window affixed to the viewing aperture for enabling the determination of the backup glove box availability without the necessity of opening the cover.

8. The glove dispensing device of claim 7, further comprising a catch tray having a upwardly concavely curved panel and side panels attached to the ends of the curved panel, said catch tray mounted to the bottom panel of the housing.

* * * * *